US011802500B2

(12) United States Patent
Ikeda et al.

(10) Patent No.: US 11,802,500 B2
(45) Date of Patent: Oct. 31, 2023

(54) CONTROL DEVICE FOR INTERNAL COMBUSTION ENGINE

(71) Applicant: TOYOTA JIDOSHA KABUSHIKI KAISHA, Toyota (JP)

(72) Inventors: Yuto Ikeda, Okazaki (JP); Yuki Nose, Nagoya (JP); Takanobu Gotoh, Obu (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 13 days.

(21) Appl. No.: 17/457,493

(22) Filed: Dec. 3, 2021

(65) Prior Publication Data

US 2022/0178287 A1 Jun. 9, 2022

(30) Foreign Application Priority Data

Dec. 8, 2020 (JP) ..... 2020-203227

(51) Int. Cl.

| | |
|---|---|
| ***F01N 3/00*** | (2006.01) |
| ***F01N 3/20*** | (2006.01) |
| ***F02D 41/00*** | (2006.01) |
| ***F02D 41/14*** | (2006.01) |
| ***F01N 3/021*** | (2006.01) |
| ***F02D 41/02*** | (2006.01) |

(52) U.S. Cl.

CPC ..... *F01N 3/2006* (2013.01); *F01N 3/021* (2013.01); *F02D 41/008* (2013.01); *F02D 41/024* (2013.01); *F02D 41/1454* (2013.01); *F02D 2200/0804* (2013.01)

(58) Field of Classification Search

CPC .... F01N 3/2006; F01N 3/021; F01N 2430/02; F01N 2900/1602; F02D 41/008; F02D 41/024; F02D 41/1454; F02D 2200/0804

See application file for complete search history.

(56) References Cited

U.S. PATENT DOCUMENTS

| | | | | |
|---|---|---|---|---|
| 5,616,835 | A * | 4/1997 | Schnaibel | F02D 41/1494 123/697 |
| 6,389,806 | B1 * | 5/2002 | Glugla | F02D 41/1443 60/284 |
| 2007/0271904 | A1 * | 11/2007 | Shouda | F01N 9/005 60/284 |
| 2010/0199640 | A1 * | 8/2010 | Kodo | F02D 41/0245 60/299 |
| 2016/0052508 | A1 * | 2/2016 | Teraya | B60W 10/06 903/905 |

(Continued)

FOREIGN PATENT DOCUMENTS

| | | | |
|---|---|---|---|
| JP | 06-257488 | A | 9/1994 |
| JP | 2011-27018 | A | 2/2011 |

(Continued)

*Primary Examiner* — Matthew T Largi

(74) *Attorney, Agent, or Firm* — Oblon, McClelland, Maier & Neustadt, L.L.P.

(57) ABSTRACT

When a temperature increasing process is performed, a CPU sets a target temperature of a catalyst to be lower when a coolant temperature is low than when the coolant temperature is high. The CPU decreases an increase coefficient of fuel in the temperature increasing process when a value obtained by subtracting an estimated value of a temperature of the catalyst from the target temperature is equal to or less than a first prescribed value.

6 Claims, 5 Drawing Sheets

(56) References Cited

U.S. PATENT DOCUMENTS

| | | | | |
|---|---|---|---|---|
| 2016/0061128 | A1* | 3/2016 | Nicholson | F01N 3/035 60/284 |
| 2016/0222899 | A1* | 8/2016 | Glugla | F02D 41/1446 |
| 2016/0290260 | A1* | 10/2016 | Marlett | F01N 11/002 |
| 2018/0179972 | A1 | 6/2018 | Nose et al. | |

FOREIGN PATENT DOCUMENTS

| | | | |
|---|---|---|---|
| JP | 2011-69281 | A | 4/2011 |
| JP | 2017-133488 | A | 8/2017 |
| JP | 2018-105234 | A | 7/2018 |
| JP | 2020-133513 | A | 8/2020 |

* cited by examiner

CONTROL DEVICE FOR INTERNAL COMBUSTION ENGINE

CROSS-REFERENCE TO RELATED APPLICATION

This application claims priority to Japanese Patent Application No. 2020-203227 filed on Dec. 8, 2020, incorporated herein by reference in its entirety.

BACKGROUND

1. Technical Field

The present disclosure relates to a control device for an internal combustion engine.

2. Description of Related Art

For example, in Japanese Unexamined Patent Application Publication No. 2018-105234 (JP 2018-105234 A), a device that performs a temperature increasing process on a catalyst by setting an air-fuel ratio of an air-fuel mixture in one cylinder in an internal combustion engine with four cylinders to be richer than a stoichiometric air-fuel ratio and setting an air-fuel ratio of an air-fuel mixture in the other cylinders to be leaner than the stoichiometric air-fuel ratio is disclosed. In the device, an increase in temperature due to the temperature increasing process is calculated by subtracting a temperature of the catalyst, which is calculated using a map for defining a relationship between a rotation speed and a load of a crank shaft of an internal combustion engine and the temperature of the catalyst, from an upper-limit temperature. The device calculates a rate of increase/decrease of an amount of fuel required for setting an air-fuel ratio of an air-fuel mixture to be rich or lean through the temperature increasing process with respect to an amount of fuel required for setting the air-fuel ratio to a stoichiometric air-fuel ratio such that an increase in temperature of the catalyst through the temperature increasing process is the calculated increase in temperature.

SUMMARY

When the temperature of the internal combustion engine is low, a phenomenon in which some of injected fuel is not provided to combustion in a combustion stroke but is attached to an intake system or a cylinder wall surface occurs. In this case, the attached fuel is vaporized due to the increase in temperature of the internal combustion engine at the time of performing the temperature increasing process, and thus a greater amount of unburned fuel than expected flows into the catalyst. Accordingly, an actual increase in temperature becomes greater than an amount which is expected as the increase in temperature due to the temperature increasing process, and there is concern about excessive heating of the catalyst.

Configurations for solving the aforementioned problem and operational advantages thereof will be described below.

(1) A control device for an internal combustion engine that is applied to a multi-cylinder internal combustion engine including a post-processing device for exhaust gas in an exhaust passage, the control device being configured to perform: an acquisition process of acquiring a temperature of the multi-cylinder internal combustion engine; a setting process of setting a target temperature of the post-processing device; and a temperature increasing process of increasing a temperature of the post-processing device to the target temperature, wherein the temperature increasing process includes a stopping process and a rich combustion process, wherein the stopping process is a process of stopping combustion control in at least one cylinder of a plurality of cylinders, wherein the rich combustion process is a process of setting an air-fuel ratio of an air-fuel mixture in the other cylinders other than the at least one cylinder out of the plurality of cylinders to be less than a stoichiometric air-fuel ratio, and wherein the setting process is a process of setting the target temperature to a lower temperature when the temperature acquired in the acquisition process is low than when the temperature is high.

In this configuration, the post-processing device is heated by heat of a reaction between oxygen flowing from a cylinder in which combustion control has been stopped to the exhaust passage and unburned fuel flowing from a cylinder subjected to a rich combustion process to the exhaust passage through the temperature increasing process. When the temperature of the internal combustion engine is low, some of fuel which is to be combusted in the combustion stroke is actually likely to be attached to at least one of an intake system and a cylinder wall surface without being provided to combustion. When the attached fuel is vaporized, a more amount of fuel than expected may flow into the post-processing device in the temperature increasing process. On the other hand, with the aforementioned configuration, the target temperature in the temperature increasing process is set to be lower when the temperature of the internal combustion engine is low than when the temperature is high. Accordingly, even when the temperature of the post-processing device is higher than the target temperature, it is possible to prevent the temperature of the post-processing device from becoming higher than an upper-limit temperature.

(2) The control device for an internal combustion engine according to (1), wherein the control device is configured to further perform a temperature estimating process of calculating an estimated value of the temperature of the post-processing device based on a value of a rich combustion variable, wherein the rich combustion variable is a variable indicating the air-fuel ratio of an air-fuel mixture in the other cylinders in the rich combustion process, and wherein the rich combustion process includes a process of decreasing a degree of enrichment when an amount by which the estimated value is lower than the target temperature is small compared with when the amount is large.

Since the value of the rich combustion variable has a correlation with an amount of combustion energy at the time of performing the temperature increasing process, the temperature of the post-processing device can be estimated in the estimation process by using the value of the rich combustion variable. With this configuration, by decreasing the degree of enrichment when the amount by which the estimated value is less than the target value is small compared with when the amount is large, it is possible to prevent the temperature of the post-processing device from becoming higher than the target temperature due to the temperature increasing process. When an amount of unburned fuel flowing into the post-processing device due to vaporization of the fuel attached to at least one of the intake system and the cylinder wall surface without being provided to combustion in the combustion stroke is greater than an expected value due to the temperature increasing process, the estimated value may be lower than an actual temperature of the post-processing device. This situation is likely to occur when the temperature of the internal combustion engine is low. Therefore, with the aforementioned configuration, by setting the target temperature to a low value when the temperature of the internal combustion engine is low, it is possible to prevent the actual temperature of the post-processing device from becoming greater than the upper-limit temperature of the post-processing device even when the actual temperature is higher than the low-set target temperature.

(3) The control device for an internal combustion engine according to (1) or (2), wherein the setting process includes a process of updating the target temperature based on the temperature acquired in the acquisition process at predetermined intervals.

With this configuration, it is possible to increase the target temperature with an increase in temperature of the internal combustion engine by updating the target temperature based on the temperature of the internal combustion engine at that time. Accordingly, since an amount of unburned fuel flowing into the post-processing device due to vaporization of fuel attached to at least one of the intake system and the cylinder wall surface decreases, it is possible to increase the target temperature. As a result, it is possible to curb a situation in which temperature increasability is unnecessarily lowered through the setting process.

(4) The control device for an internal combustion engine according to (3), wherein the post-processing device includes a filter that collects particulate matter in exhaust gas, wherein the control device is configured to perform a determination process of determining that there is a request for performing the temperature increasing process when an amount of particulate matter collected by the filter is equal to or greater than a threshold value, and wherein the temperature increasing process is a process which is performed when it is determined in the determination process that there is a request for performing the temperature increasing process and an operation state of the internal combustion engine satisfies a predetermined condition and which is completed when the amount of particulate matter is equal to or less than a predetermined amount, and is stopped when the predetermined condition is not satisfied while the temperature increasing process is being performed, and is then restarted when the predetermined condition is satisfied again.

With this configuration, when the predetermined condition is satisfied after the temperature increasing process has been stopped due to the predetermined condition not being satisfied while the temperature increasing process is being performed, the temperature increasing process is restarted. In this case, with this configuration, since the target temperature of the temperature increasing process can be calculated based on the temperature of the internal combustion engine when the temperature increasing process is restarted, it is possible to more appropriately set the target temperature at the time of restarting in comparison with a case in which the target temperature before the temperature increasing process has been stopped is continuously used.

(5) The control device for an internal combustion engine according to any one of (1) to (4), wherein the setting process is a process of setting the target temperature to three or more different values for each temperature acquired in the acquisition process.

The amount of fuel which is not provided to combustion in the combustion stroke but is attached to one of the intake system and the cylinder wall surface is likely to increase as the temperature of the internal combustion engine decreases. Accordingly, the amount by which the amount of unburned fuel flowing into the post-processing device is greater than an expected amount due to vaporization of the fuel attached to one of the intake system and the cylinder wall surface can increase greatly as the temperature of the internal combustion engine decreases. Therefore, with the aforementioned configuration, by setting the target temperature to three or more different values according to the temperature of the internal combustion engine, it is possible to enhance temperature increasability while curbing excessive heating of the post-processing device in comparison with a case in which the target temperature is set to one of two different values.

(6) The control device for an internal combustion engine according to any one of (1) to (5), wherein the control device is configured to further perform: a feedback process of performing feedback control such that the air-fuel ratio of the air-fuel mixture reaches a target air-fuel ratio; and a prohibition process of prohibiting the feedback process when the temperature increasing process is being performed.

With this configuration, since the feedback process is prohibited at the time of performing the temperature increasing process, it is unlikely that an amount of fuel injected from a fuel injection valve when fuel attached to one of the intake system and the cylinder wall surface is vaporized at the time of performing the temperature increasing process will decrease. Accordingly, since the vaporized fuel is likely to cause an increase in the amount of fuel flowing into the post-processing device compared with that expected, the usefulness of this setting process great.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein.

DETAILED DESCRIPTION OF EMBODIMENTS

Hereinafter, an embodiment of the present disclosure will be described with reference to the accompanying drawings.

Figure 1:
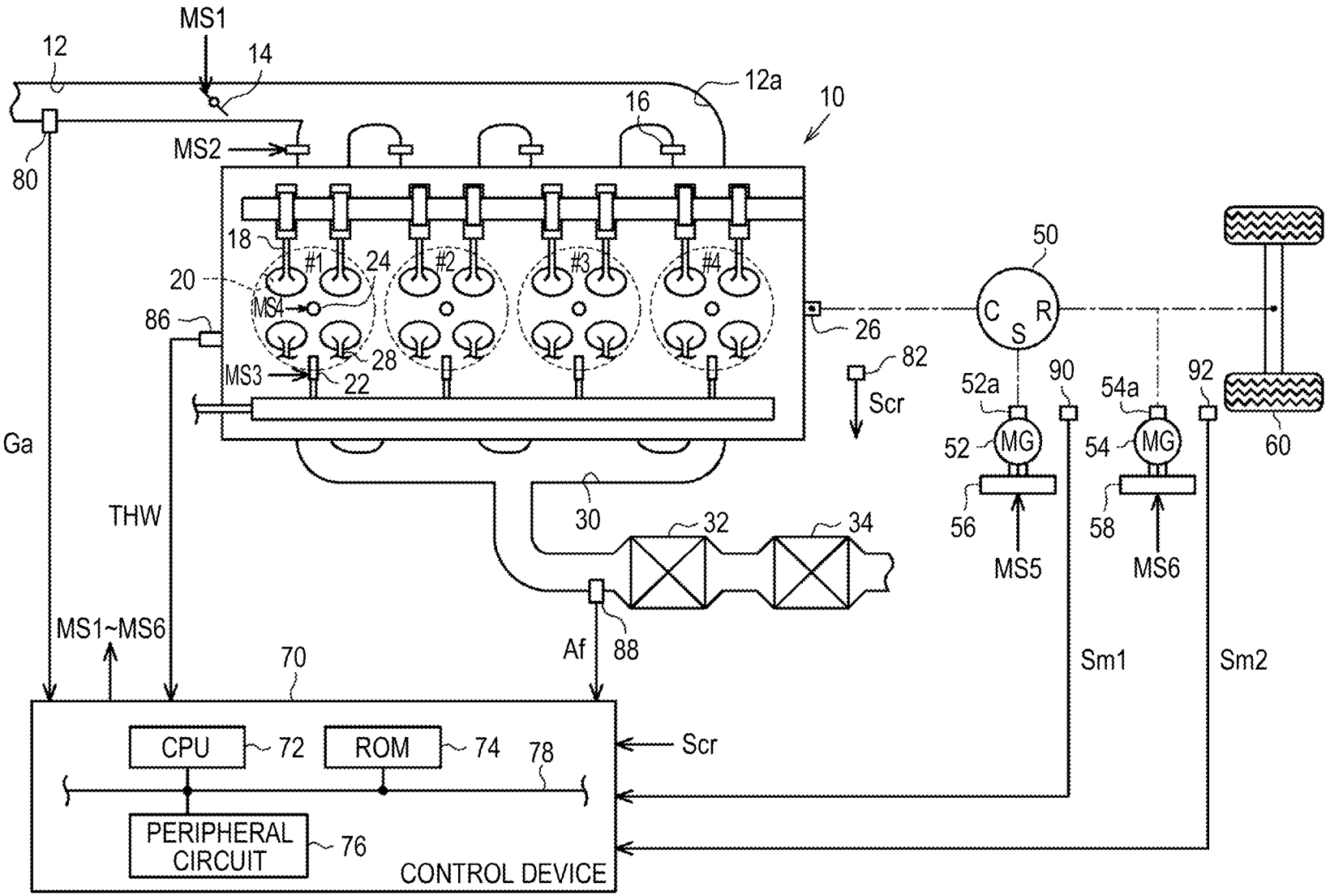
FIG. 1 is a diagram illustrating a control device and a drive system according to an embodiment.

As illustrated in FIG. 1, an internal combustion engine 10 includes four cylinders #1 to #4. A throttle valve 14 is provided in an intake passage 12 of the internal combustion engine 10. A port injection valve 16 that injects fuel to an intake port 12*a* is provided in an intake port 12*a* which is a part downstream in the intake passage 12. Air taken into the intake passage 12 or fuel injected from the port injection valve 16 flows into a combustion chamber 20 by opening an intake valve 18. Fuel is injected into the combustion chamber 20 from a cylinder injection valve 22. An air-fuel mixture in the combustion chamber 20 is provided for combustion accompanying spark discharge of an ignition plug 24. Combustion energy which is generated at that time is converted to rotation energy of a crank shaft 26.

The air-fuel mixture provided for combustion in the combustion chamber 20 is discharged as exhaust gas to an exhaust passage 30 by opening an exhaust valve 28. A three-way catalyst 32 having an oxygen storage capacity and a gasoline particulate filter (GPF) 34 are provided in the exhaust passage 30. In this embodiment, it is assumed that the GPF 34 has a configuration in which a three-way catalyst having an oxygen storage capacity is carried on a filter that captures particulate matter (PM).

The crank shaft 26 is mechanically connected to a carrier C of a planetary gear mechanism 50 constituting a power split device. A rotation shaft 52*a* of a first motor generator 52 is mechanically connected to a sun gear S of the planetary gear mechanism 50. A rotation shaft 54*a* of a second motor generator 54 and driving wheels 60 are mechanically connected to a ring gear R of the planetary gear mechanism 50. An AC voltage is applied to a terminal of the first motor generator 52 by an inverter 56. An AC voltage is applied to a terminal of the second motor generator 54 by an inverter 58.

A control device 70 controls the internal combustion engine 10 and operates operation units of the internal combustion engine 10 such as the throttle valve 14, the port injection valve 16, the cylinder injection valve 22, and the ignition plug 24 such that a torque and an exhaust gas component proportion which are control parameters of the internal combustion engine 10 are controlled. The control device 70 also controls the first motor generator 52 and operates the inverter 56 such that a rotation speed which is a control parameter of the first motor generator 52 is controlled. The control device 70 also controls the second motor generator 54 and operates the inverter 58 such that a torque which is a control parameter of the second motor generator 54 is controlled. Operation signals MS1 to MS6 for the throttle valve 14, the port injection valve 16, the cylinder injection valve 22, the ignition plug 24, and the inverters 56 and 58 are illustrated in FIG. 1. The control device 70 controls the control parameters of the internal combustion engine 10 with reference to an amount of intake air Ga which is detected by an air flowmeter 80, an output signal Scr from a crank angle sensor 82, a coolant temperature THW which is detected by a coolant temperature sensor 86, and an air-fuel ratio Af which is detected by an air-fuel ratio sensor 88 provided upstream from the three-way catalyst 32. The control device 70 controls the control parameters of the first motor generator 52 or the second motor generator 54 with reference to an output signal Sm1 from a first rotation angle sensor 90 that detects a rotation angle of the first motor generator 52 and an output signal Sm2 from a second rotation angle sensor 92 that detects a rotation angle of the second motor generator 54.

The control device 70 includes a CPU 72, a ROM 74, and a peripheral circuit 76, which are communicatively connected to each other via a communication line 78. Here, the peripheral circuit 76 includes a circuit that generates a clock signal for defining internal operations, a power supply circuit, and a reset circuit. The control device 70 controls the control parameters by causing the CPU 72 to execute a program stored in the ROM 74.

The CPU 72 particularly performs a regeneration process of the GPF 34, a process associated with estimation of the temperature of the three-way catalyst 32 and a process associated with control of the temperature of the three-way catalyst 32 at the time of performing the regeneration process in accordance with the program stored in the ROM 74. A routine of these processes will be described below.

Regeneration Process for GPF 34

Figure 2:
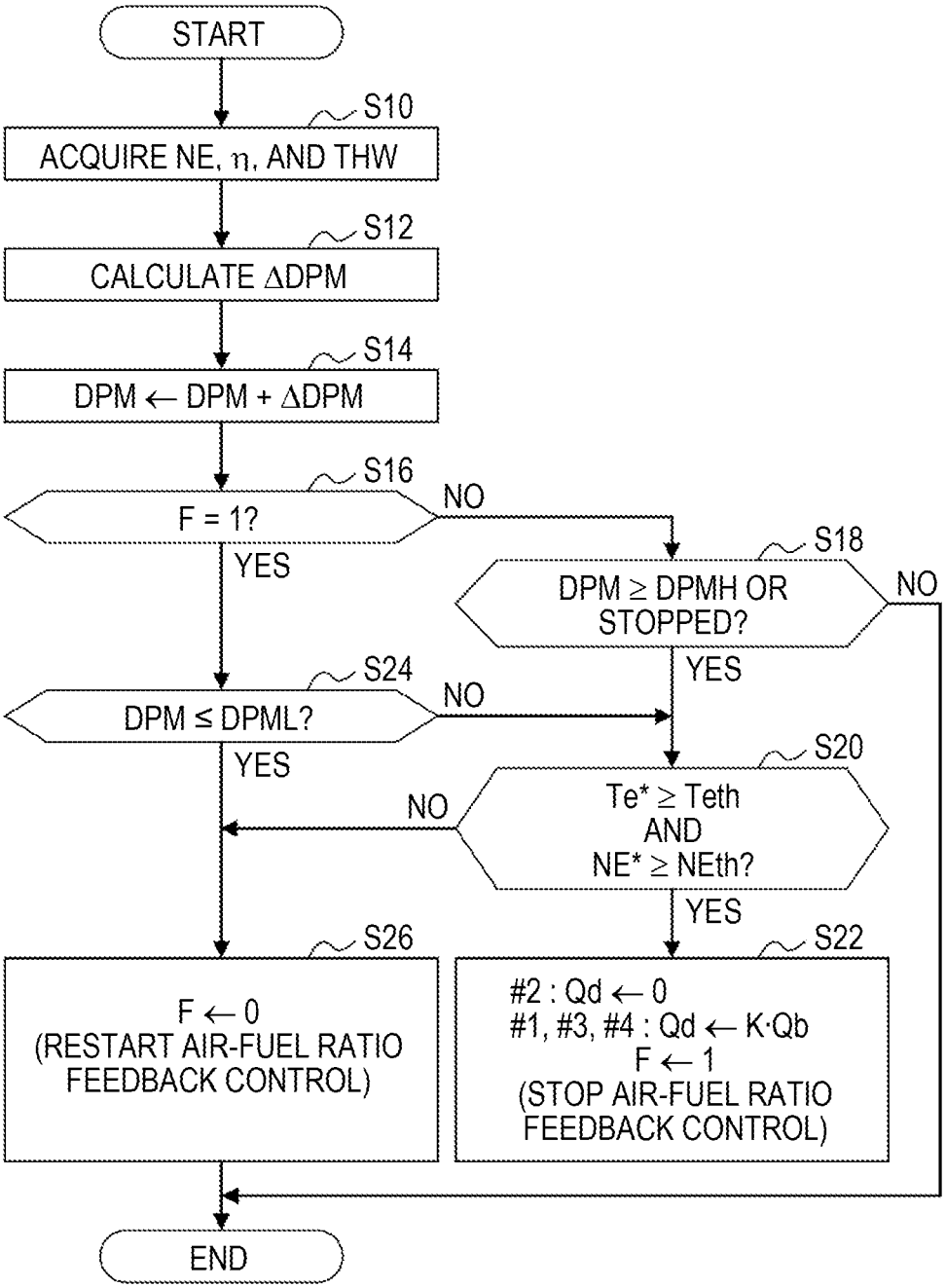
FIG. 2 is a flowchart illustrating a routine of processes which are performed by the control device according to the embodiment.

FIG. 2 illustrates a routine of the regeneration process. The routine illustrated in FIG. 2 is realized by causing the CPU 72 to execute the program stored in the ROM 74, for example, repeatedly at predetermined intervals. Step numbers of the processes are expressed by numerals prefixed with "S" in the following description.

In a series of processes illustrated in FIG. 2, first, the CPU 72 acquires a rotation speed NE, a charging efficiency and a coolant temperature THW (S10). The rotation speed NE is calculated based on the output signal Scr by the CPU 72. The charging efficiency η is calculated based on an amount of intake air Ga and the rotation speed NE by the CPU 72. Then, the CPU 72 calculates a deposition amount DPM and an update amount ΔDPM based on the rotation speed NE, the charging efficiency η, and the coolant temperature THW (S12). Here, the deposition amount DPM is an amount of PM collected by the GPF 34. Specifically, the CPU 72 calculates an amount of PM in exhaust gas discharged to the exhaust passage 30 based on the rotation speed NE, the charging efficiency η, and the coolant temperature THW. The CPU 72 calculates the temperature of the GPF 34 based on the rotation speed NE and the charging efficiency η. Then, the CPU 72 calculates the update amount ΔDPM based on the amount of PM in exhaust gas or the temperature of the GPF 34. The update amount ΔDPM can be calculated based on an increase coefficient K at the time of performing the process of S22 which will be described later.

Then, the CPU 72 updates the deposition amount DPM based on the update amount ΔDPM (S14). Then, the CPU 72 determines whether an execution flag F is "1" (S16). The execution flag F indicates that the temperature increasing process for combusting and removing PM of the GPF 34 is being performed when it is "1," and indicates otherwise when it is "0." When it is determined that the execution flag F is "0" (S16: NO), the CPU 72 determines whether a logical sum of a value indicating that the deposition amount DPM is equal to or greater than a regeneration execution value DPMH and a value indicating that the process of S22 which will be described later is stopped is true (S18). The regeneration execution value DPMH is set to a value at which the amount of PM collected by the GPF 34 is large and the PM needs to be removed.

When it is determined that the logical sum is true (S18: YES), the CPU 72 determines whether a condition indicating that a logical product of Condition (A) and Condition (B) which are execution conditions of the temperature increasing process is true is satisfied (S20).

Condition (A): A condition indicating that an engine torque command value Te* which is a command value of a torque for the internal combustion engine 10 is equal to or greater than a predetermined value Teth Condition (B): A condition indicating that the rotation speed NE of the internal combustion engine 10 is equal to or higher than a predetermined speed When it is determined that the logical product is true (S20: YES), the CPU 72 performs the temperature increasing process and substitutes "1" into the execution flag F (S22). As the temperature increasing process according to this embodiment, the CPU 72 stops injection of fuel from the port injection valve 16 and the cylinder injection valve 22 of Cylinder #2 and sets the air-fuel ratio of the air-fuel mixture in the combustion chambers 20 of Cylinders #1, #3, and #4 to be richer than the stoichiometric air-fuel ratio. First, this process is a process for increasing the temperature of the three-way catalyst 32. That is, unburned fuel in the three-way catalyst 32 is oxidized to increase the temperature of the three-way catalyst 32 by discharging oxygen and unburned fuel to the exhaust passage 30. Second, the process is a process for oxidizing and removing PM collected by the GPF 34 by increasing the temperature of the GPF 34 and supplying oxygen to the GPF 34 having increased in temperature. That is, when the temperature of the three-way catalyst 32 becomes higher, exhaust gas of a high temperature flows into the GPF 34 and thus the temperature of the GPF 34 increases. When oxygen flows into the GPF 34 having increased in temperature, the PM collected by the GPF 34 is removed by oxidization.

Specifically, the CPU 72 substitutes "0" into a required injection amount Qd for the port injection valve 16 and the cylinder injection valve 22 of Cylinder #2. On the other hand, the CPU 72 substitutes a value, which is obtained by multiplying a base injection amount Qb which is an injection amount for causing the air-fuel ratio of the air-fuel mixture to reach the stoichiometric air-fuel ratio by the increase coefficient K, into the required injection amount Qd of Cylinders #1, #3, and #4.

The CPU 72 sets the increase coefficient K such that the air-fuel ratio of the air-fuel mixture in Cylinders #1, #3, and #4 is equal to or less than an amount by which unburned fuel in exhaust gas discharged from Cylinders #1, #3, and #4 to the exhaust passage 30 reacts properly with oxygen discharged from Cylinder #2. Specifically, the CPU 72 sets the air-fuel ratio of the air-fuel mixture in Cylinders #1, #3, and #4 to a value closest to the amount by which unburned fuel reacts properly such that the temperature of the three-way catalyst 32 increases early at the initial time of the regeneration process of the GPF 34.

The CPU 72 stops air-fuel ratio feedback control when the temperature increasing process is performed.

On the other hand, when it is determined that the execution flag F is "1" (S16: YES), the CPU 72 determines whether the deposition amount DPM is equal to or less than a stopping threshold value DPML (S24). The stopping threshold value DPML is set to a value at which the amount of PM collected by the GPF 34 is sufficiently small and the regeneration process can be stopped. When the deposition amount DPM is equal to or less than the stopping threshold value DPML (S24: YES) or when the determination result of S20 is negative, the CPU 72 pauses or stops the process of S22 and substitutes "0" into the execution flag F (S26). Here, the process of S22 is determined to be completed and is paused when the determination result of S24 is positive, and the process of S22 is stopped in a state in which it has not been completed when the determination result of S20 is negative. The CPU 72 restarts the air-fuel ratio feedback control. That is, the CPU 72 calculates an operation amount for performing feedback control such that the air-fuel ratio Af reaches a target air-fuel ratio with a difference between the air-fuel ratio Af and the target air-fuel ratio as an input, and corrects an amount of fuel injected from at least one of the port injection valve 16 and the cylinder injection valve 22 based on the calculated operation amount.

When the processes of S22 and S26 are completed or when the determination result of S18 is negative, the CPU 72 temporarily ends a series of processes illustrated in FIG. 2.

Process of Estimating Temperature of Three-Way Catalyst 32

Figure 3:
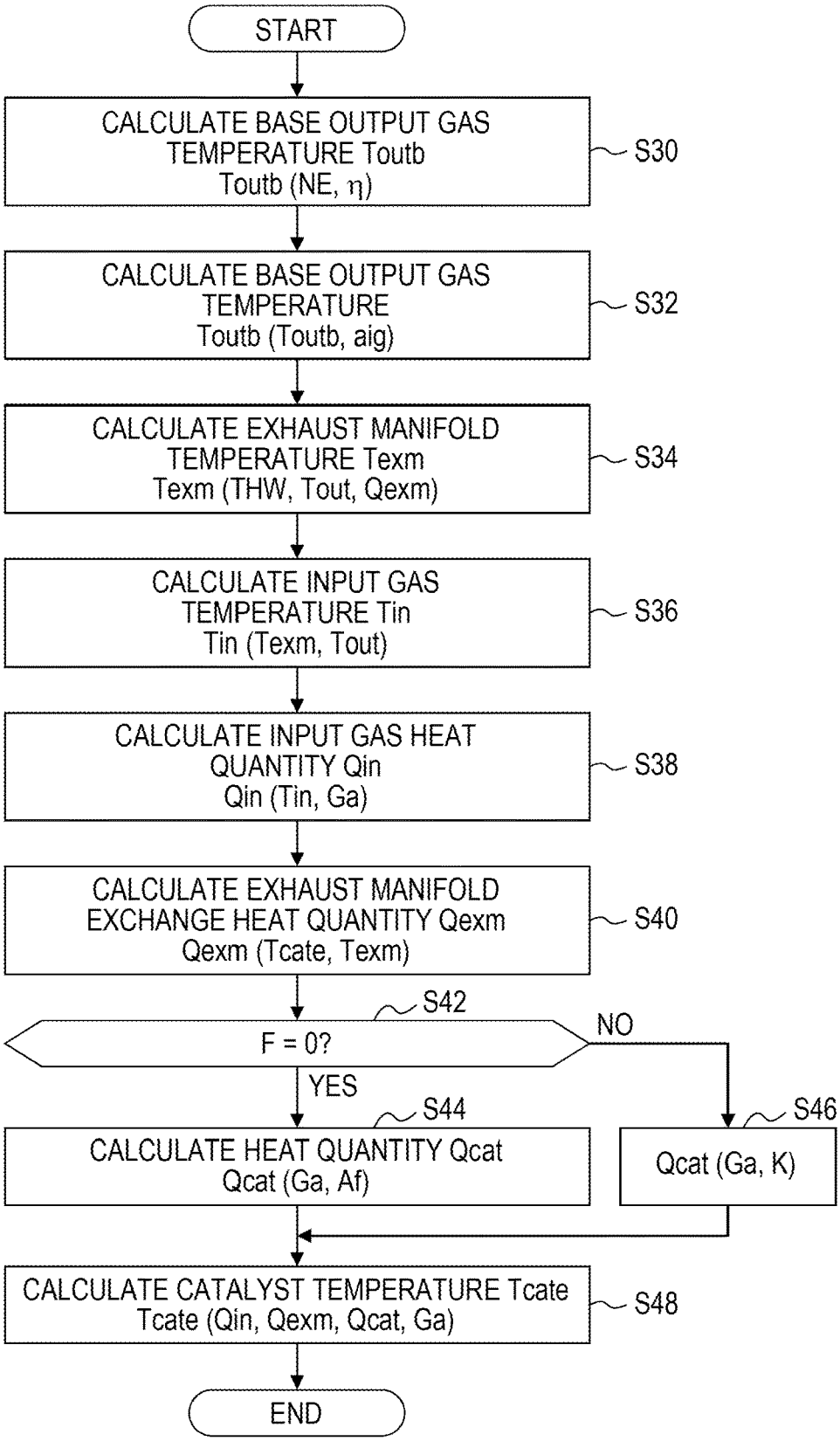
FIG. 3 is a flowchart illustrating a routine of processes which are performed by the control device according to the embodiment.

FIG. 3 illustrates a routine of a process of estimating a temperature. The routine illustrated in FIG. 3 is realized by causing the CPU 72 to execute the program stored in the ROM 74 repeatedly at intervals of one combustion cycle.

In a series of processes illustrated in FIG. 3, first, the CPU 72 calculates a base output gas temperature Toutb based on the rotation speed NE of the crank shaft 26 and the charging efficiency η (S30). The base output gas temperature Toutb is an estimated value serving as a base of the temperature of exhaust gas flowing out to the exhaust passage 30. Specifically, the CPU 72 map-calculates the base output gas temperature Toutb in a state in which map data for defining a relationship between the rotation speed NE and the charging efficiency η as input variables and the base output gas temperature Toutb as an output variable is stored in advance in the ROM 74. Here, map data is group data including discrete values of the input variables and a value of the output variable corresponding to the values of the input variables. The map calculation may be, for example, a process of outputting a value of the output variable of the corresponding map data as a calculation result when a value of an input variable corresponds to one of the values of the input variables of the map data and outputting a value obtained by interpolation of the values of a pair of output variables included in the map data as a calculation result when they do not correspond to each other.

Then, the CPU 72 calculates an output gas temperature Tout based on the base output gas temperature Toutb and an ignition timing aig (S32). Here, the CPU 72 calculates the output gas temperature Tout as a greater value as the ignition timing aig is further delayed. This can be performed, for example, by a process of setting the base output gas temperature Toutb to a value when the ignition timing aig is a predetermined value and calculating the output gas temperature Tout as a greater value with respect to the base output gas temperature Toutb as the ignition timing aig is further delayed than the predetermined value.

Then, the CPU 72 estimates an exhaust manifold temperature Texm based on the coolant temperature THW, the output gas temperature Tout, and an exhaust manifold exchange heat quantity Qexm (S34). The exhaust manifold temperature Texm is a temperature of the exhaust passage 30 upstream from the three-way catalyst 32. The exhaust manifold exchange heat quantity Qexm is a quantity of heat flowing from the upstream exhaust passage 30 to the three-way catalyst 32. In the process of S34, the exhaust manifold exchange heat quantity Qexm which is calculated in the process of S40 which will be described later at the previous execution timing in the series of processes illustrated in FIG. 3 is used.

Specifically, the CPU 72 estimates the exhaust manifold temperature Texm based on a decrease in temperature due to heat exchange between a cylinder block side and the exhaust passage 30, an increase in temperature due to exchange of heat with exhaust gas, and a change in temperature due to the exhaust manifold exchange heat quantity Qexm. Here, the CPU 72 calculates the decrease in temperature as a larger value when an amount by which the current exhaust manifold temperature Texm is higher than the coolant temperature THW is great than when the amount is small. The CPU 72 calculates the increase in temperature as a larger value when an amount by which the output gas temperature Tout is higher than the current exhaust manifold temperature Texm is great than when the amount is small. The CPU 72 calculates the change in temperature as a larger decrease value when the exhaust manifold exchange heat quantity Qexm is larger than when the exhaust manifold exchange heat quantity Qexm is small.

Then, the CPU 72 calculates an input gas temperature Tin based on the exhaust manifold temperature Texm and the output gas temperature Tout (S36). The input gas temperature Tin is a temperature of exhaust gas flowing into the three-way catalyst 32. The CPU 72 sets a value obtained by decreasing the output gas temperature Tout as the input gas temperature Tin and calculates a decrease value as a larger value when an amount by which the output gas temperature Tout is higher than the exhaust manifold temperature Texm is great than when the amount is small.

Then, the CPU 72 calculates an input gas heat quantity Qin (S38). The input gas heat quantity Qin is an operational parameter for calculating the temperature of the three-way catalyst 32 and is a quantity of heat of exhaust gas flowing into the three-way catalyst 32 per unit time. The CPU 72 calculates the input gas heat quantity Qin as a larger value when the input gas temperature Tin is high than when the input gas temperature Tin is low, and calculates the input gas heat quantity Qin as a larger value when the amount of intake air Ga is great than when the amount of intake air Ga is small.

Then, the CPU 72 calculates the exhaust manifold exchange heat quantity Qexm based on the estimated value Tcate of the temperature of the three-way catalyst 32 and the exhaust manifold temperature Texm (S40) Specifically, the CPU 72 sets a value obtained by multiplying a value, which is obtained by subtracting the estimated value Tcate from the exhaust manifold temperature Texm, by a predetermined coefficient as the exhaust manifold exchange heat quantity Qexm. In the process of S40, the CPU 72 employs a value calculated through the process of S48 which will be described later at the previous execution timing in the routine illustrated in FIG. 3 as the estimated value Tcate.

Then, the CPU 72 determines whether the execution flag F is "0" (S42). Then, when it is determined that the execution flag F is "0" (S42: YES), the CPU 72 calculates a heat quantity Qcat emitted from the three-way catalyst 32 based on the amount of intake air Ga and the air-fuel ratio Af (S44). When the air-fuel ratio Af is richer than the stoichiometric air-fuel ratio, the CPU 72 calculates the heat quantity Qcat as a larger value when the degree of enrichment is great than when the degree of enrichment is small. When the air-fuel ratio Af is richer than the stoichiometric air-fuel ratio, the CPU 72 calculates the heat quantity Qcat as a larger value when the amount of intake air Ga is great than when the amount of intake air Ga is small. This is set in consideration of the fact that a combustion heat quantity of unburned fuel is greater when an amount of unburned fuel is great than when the amount of unburned fuel is small. When the air-fuel ratio Af is leaner than the stoichiometric air-fuel ratio, the CPU 72 calculates the heat quantity Qcat as a larger value when a degree of leanness is great than when the degree of leanness is small. When the air-fuel ratio Af is leaner than the stoichiometric air-fuel ratio, the CPU 72 calculates the heat quantity Qcat as a larger value when the amount of intake air Ga is great than when the amount of intake air Ga is small. This is set in consideration of the fact that a reaction heat quantity is greater when an amount of oxygen reacting with cerium of the three-way catalyst 32 is great than when the amount of oxygen is small.

On the other hand, when it is determined that the execution flag F is "1" (S42: NO), the CPU 72 calculates the heat quantity Qcat based on the amount of intake air Ga and the increase coefficient K (S46). The CPU 72 calculates the heat quantity Qcat as a larger value when the increase coefficient K is great than when the increase coefficient K is small. The CPU 72 calculates the heat quantity Qcat as a larger value when the amount of intake air Ga is great than when the amount of intake air Ga is small.

When the processes of S44 and S46 are completed, the CPU 72 calculates the estimated value Tcate based on the input gas heat quantity Qin, the exhaust manifold exchange heat quantity Qexm, the heat quantity Qcat, and the amount of intake air Ga (S48). The CPU 72 calculates an increase of a current value of the estimated value Tcate with respect to the previous value thereof as a larger value when the sum of the input gas heat quantity Qin, the exhaust manifold exchange heat quantity Qexm, and the heat quantity Qcat is great than when the sum is small. The CPU 72 calculates the increase of the current value of the estimated value Tcate with respect to the previous value thereof as a smaller value when the amount of intake air Ga is great than when the amount of intake air Ga is small. Specifically, the process of S48 may be a process of calculating a heat quantity of the three-way catalyst 32 by multiplying the previous value of the estimated value Tcate by the heat capacity of the three-way catalyst 32 and substituting a value, which is obtained by dividing the sum of the input gas heat quantity Qin, the exhaust manifold exchange heat quantity Qexm, and the heat quantity Qcat and the heat quantity of the three-way catalyst 32 by the heat capacity of the three-way catalyst 32 and exhaust gas, into the estimated value Tcate.

When the process of S48 is completed, the CPU 72 temporarily ends the series of processes illustrated in FIG. 3.

Process Associated with Temperature Control

Figure 4:
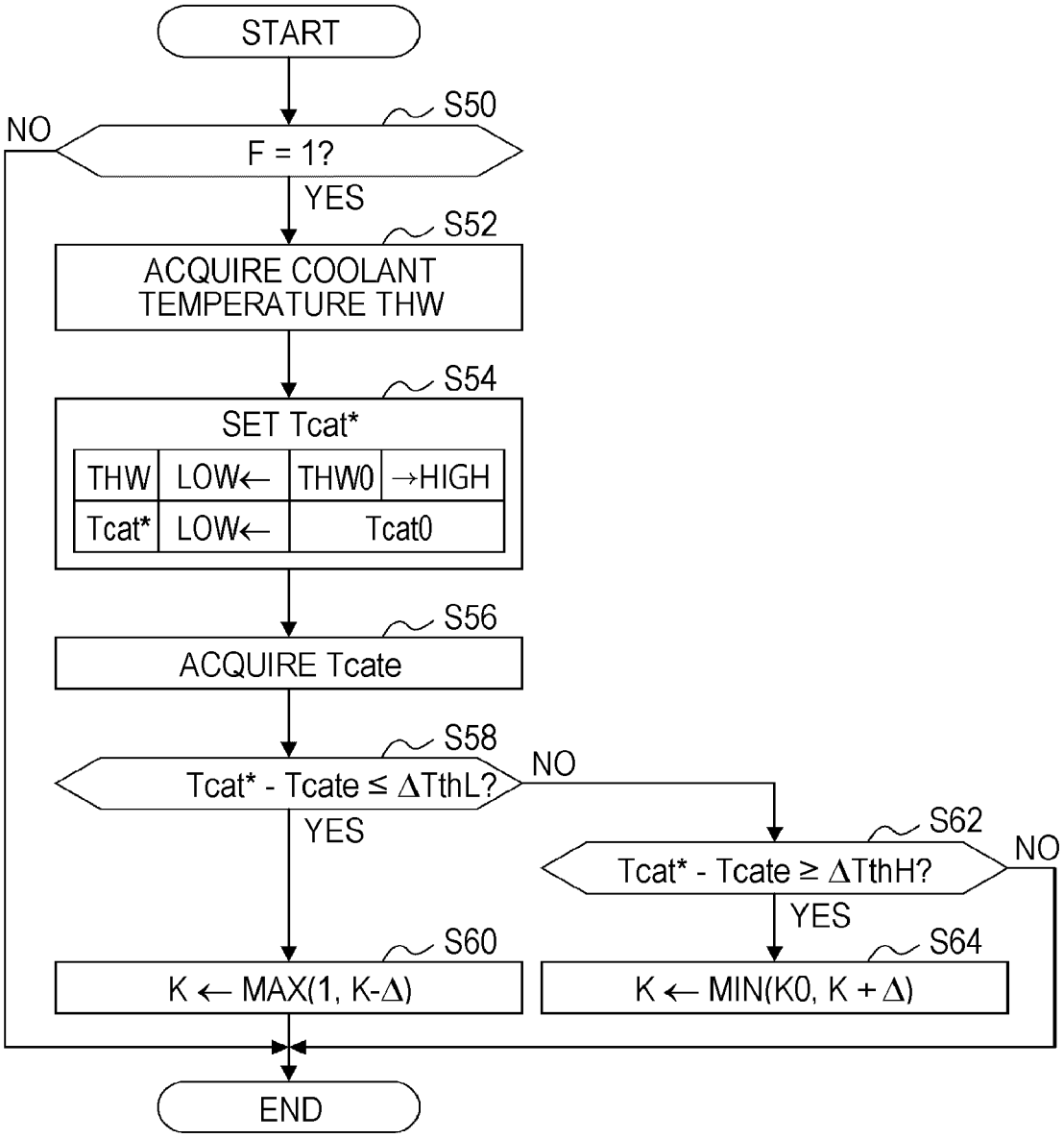
FIG. 4 is a flowchart illustrating a routine of processes which are performed by the control device according to the embodiment.

FIG. 4 illustrates a routine of a process for controlling the temperature of the three-way catalyst 32. The routine illustrated in FIG. 4 is realized by causing the CPU 72 to execute the program stored in the ROM 74, for example, repeatedly at predetermined intervals.

In a series of process illustrated in FIG. 4, the CPU 72 first determines whether the execution flag F is "1" (S50). When the execution flag F is "1" (S50: YES), the CPU 72 acquires the coolant temperature THW (S52). Then, the CPU 72 calculates the target temperature Tcat* based on the coolant temperature THW (S54).

When the coolant temperature THW is equal to or higher than a prescribed temperature THW0, the CPU 72 substitutes an upper-limit temperature Tcat0 into the target temperature Tcat*. Here, the prescribed temperature THW0 can be set to, for example, a value in a range of 0° C. to 40° C. The upper-limit temperature Tcat0 is an upper limit of the temperature which is possible for the three-way catalyst 32 in the regeneration process of the GPF 34. When the coolant temperature THW is lower than the prescribed temperature THW0, the CPU 72 calculates the target temperature Tcat* as a smaller value as the coolant temperature THW becomes lower. This process is a process of causing the CPU 72 to map-calculate the target temperature Tcat* in a state in which map data for defining a relationship between the coolant temperature THW as an input variable and the target temperature Tcat* as an output variable is stored in advance in the ROM 74.

Then, the CPU 72 acquires the estimated value Tcate (S56). Then, the CPU 72 determines whether a value obtained by subtracting the estimated value Tcate from the target temperature Tcat* is equal to or less than a first prescribed value ΔTthL (S58). Then, when it is determined the value is equal to or less than the first prescribed value ΔTthL (S58: YES), the CPU 72 substitutes the larger value of a value obtained by subtracting a prescribed value Δ from the increase coefficient K and "1" into the increase coefficient K (S60). This is a process for decreasing the heat quantity emitted in the three-way catalyst 32 by decreasing the increase coefficient K.

On the other hand, when it is determined that the value is greater than the first prescribed value ΔTthL (S58: NO), the CPU 72 determines whether a value obtained by subtracting the estimated value Tcate from the target temperature Tcat* is equal to or greater than a second prescribed value ΔTthH (S62). The second prescribed value ΔTthH is set to a value greater than the first prescribed value ΔTthL. Then, when it is determined that the value is equal to or greater than the second prescribed value ΔTthH (S62: YES), the CPU 72 substitutes the smaller value of the value obtained by adding the prescribed value Δ to the increase coefficient K and an initial value KO into the increase coefficient K (S64). The initial value KO is set to a largest value at which the air-fuel ratio of the air-fuel mixture in Cylinders #1, #3, and #4 is equal to or less than an amount by which unburned fuel in exhaust gas discharged from Cylinders #1, #3, and #4 to the exhaust passage 30 reacts properly with oxygen discharged from Cylinder #2.

When the process of S60 or S64 is completed or when the determination result of S50 or S62 is negative, the CPU 72 temporarily ends the series of processes illustrated in FIG. 4.

Operations and Advantages of this Embodiment Will be Described Below

Figure 5A:
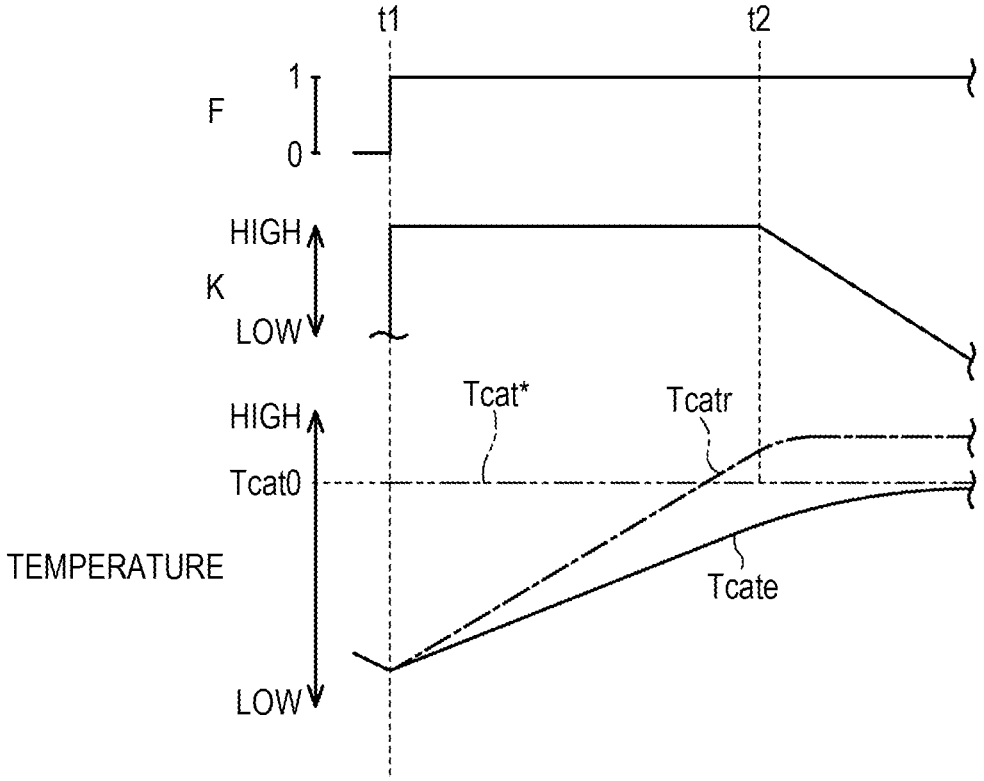
FIG. 5A is a timing chart illustrating a temperature increasing process according to a comparative example and the embodiment.
Figure 5B:
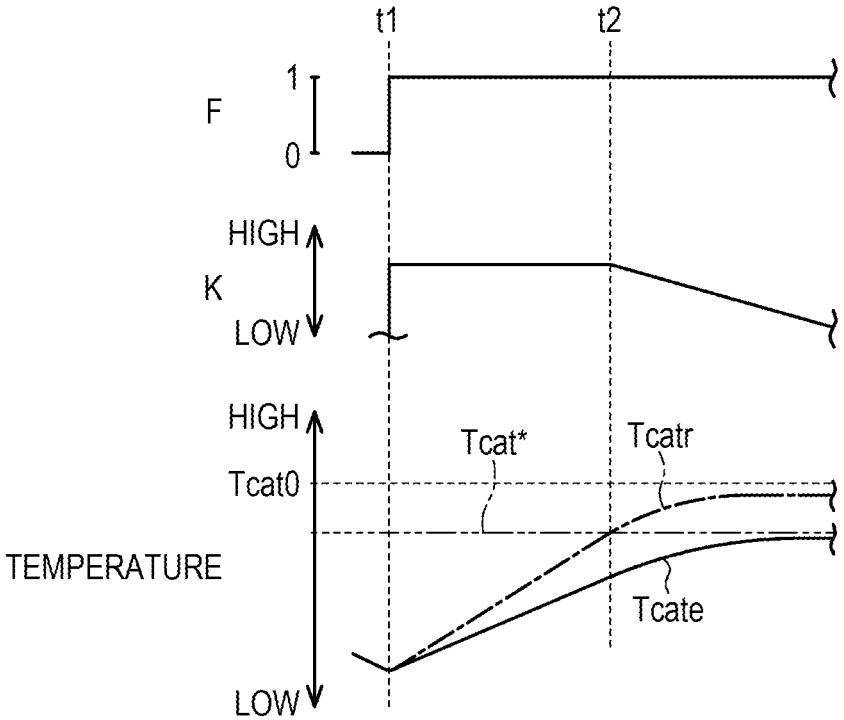
FIG. 5B is a timing chart illustrating a temperature increasing process according to a comparative example and the embodiment.

FIG. 5A and FIG. 5B illustrate the temperature increasing process according to a comparative example and the embodiment when the temperature of the internal combustion engine 10 is low.

FIG. 5A illustrates a comparative example in which the target temperature Tcat* is fixed to the upper-limit temperature Tcat0. As illustrated in FIG. 5A, in the comparative example, after time t1 at which the execution flag F is "1," the target temperature Tcat* is fixed to the upper-limit temperature Tcat0 and the temperature increasing process is performed. In this case, after time t2, since a difference between the estimated value Tcate and the target temperature Tcat* decreases and the increase coefficient K decreases, the estimated value Tcate is not higher than the target temperature Tcat* but an actual temperature Tcatr is higher than the upper-limit temperature Tcat0.

This is a phenomenon which is caused because fuel attached to the intake system or the cylinder wall surface is vaporized at the start time of the temperature increasing process and flows into the three-way catalyst 32. Here, the intake system includes the intake port 12*a* and the intake valve 18. Some of fuel injected from the port injection valve 16 when the temperature of the intake system is low does not flow into the combustion chamber 20 in an open period of the intake valve 18 in a combustion cycle in which the fuel is injected but is attached to the intake system. When the temperature of the combustion chamber 20 or the cylinder wall surface is low, some of fuel injected from the cylinder injection valve 22 is not provided for combustion but is attached to the cylinder wall surface and thus is scraped to fall by a piston.

Fuel attached to the intake system is vaporized soon and flows into the combustion chamber 20. Fuel scraped to fall by the piston becomes blowby gas and flows into to the combustion chamber 20 from the intake passage 12. When the fuel flows into the combustion chamber 20 and the execution flag F is "1," air-fuel ratio feedback control is not performed and thus the process of decreasing an amount of fuel injected from the port injection valve 16 and the cylinder injection valve 22 is not performed even when the fuel flows into the combustion chamber 20. Accordingly, fuel flowing into the combustion chamber 20 becomes a more amount of unburned fuel than expected to flow into the three-way catalyst 32.

On the other hand, in the embodiment illustrated in FIG. 5B, the target temperature Tcat* becomes lower than the upper-limit temperature Tcat0 and the temperature increasing process is performed. Accordingly, after time t2, since a difference between the estimated value Tcate and the target temperature Tcat* decreases and the increase coefficient K decreases, the actual temperature Tcatr is not higher than the upper-limit temperature Tcat0 when the estimated value Tcate is controlled such that it is not higher than the target temperature Tcat*.

According the aforementioned embodiment, the following operations and advantages are achieved.

(1) The estimated value Tcate is calculated based on the increase coefficient K, and the increase coefficient K is corrected to decrease when the estimated value Tcate reaches the target temperature Tcat*. Accordingly, it is possible to prevent the temperature of the three-way catalyst 32 from becoming higher than the target temperature Tcat*. Here, the estimated Tcate is not calculated in consideration of fuel which is attached to at least one of the intake system and the cylinder wall surface when the temperature of the internal combustion engine 10 is low and which is not provided for combustion in the combustion stroke is vaporized and flows into to the three-way catalyst 32. Accordingly, when the increase coefficient K decreases when the estimated value Tcate becomes closer to the target temperature Tcat*, the actual temperature Tcatr of the three-way catalyst 32 may become higher than the target temperature Tcat* when the temperature of the internal combustion engine 10 is low. Accordingly, the usefulness of the setting of the target temperature Tcat* according to the coolant temperature THW is great.

(2) The target temperature Tcat* is updated based on the coolant temperature THW which is acquired in each cycle of the routine illustrated in FIG. 4. Accordingly, the target temperature Tcat* can be increased with an increase of the coolant temperature THW. Accordingly, with a decrease of an amount of unburned fuel flowing into the three-way catalyst 32 due to vaporization of fuel attached to the intake system and the cylinder wall surface, the target temperature Tcat* can be increased. Accordingly, it is possible to prevent temperature increasability from decreasing unnecessarily.

(3) When the deposition amount DPM is equal to or less than the stopping threshold value DPML after the temperature increasing process has been started and a PM regeneration process of the GPF 34 has not been completed, the temperature increasing process is stopped when the determination result of S20 is negative and the temperature increasing process is restarted when the determination result of S20 is positive. In this case, the coolant temperature THW at the time of restart of the temperature increasing process may be greatly different from the coolant temperature THW immediately after the stopping. On the other hand, according to this embodiment, since the target temperature Tcat* is updated according to the coolant temperature THW at that time, it is possible to more appropriately set the target temperature Tcat* at the time of restart of the temperature increasing process.

(4) The target temperature Tcat* is set to three or more different values according to the coolant temperature THW. Accordingly, in comparison with a case in which the target temperature Tcat* is set to one of two different values, it is possible to enhance temperature increasability while preventing overheating of the three-way catalyst 32.

(5) When the temperature increasing process is performed, the air-fuel ratio feedback process is prohibited. Accordingly, when fuel attached to one of the intake system and the cylinder wall surface is vaporized at the time of performing of the temperature increasing process, it is particularly difficult to decrease an amount of fuel which is injected from the port injection valve 16 and the cylinder injection valve 22. Accordingly, since the vaporized fuel is likely to serve as a cause for increasing the amount of fuel flowing to the three-way catalyst 32 compared with that expected, the usefulness of the process of decreasing the target temperature Tcat* according to the coolant temperature THW is great.

Correspondence

The correspondence between the elements in the embodiment and the elements of the present disclosure described in the "SUMMARY" is as follows. In the following description, the correspondence is described for each number of the configurations described in the "SUMMARY". (1) A post-processing device corresponds to the three-way catalyst 32 and the GPF 34. An acquisition process corresponds to the process of S52. A setting process corresponds to the process of S54. A temperature increasing process corresponds to the process of S22. (2) The temperature increasing process corresponds to the routine illustrated in FIG. 3. The rich combustion variable corresponds to the increase coefficient K. (3) A setting process corresponds to updating the target temperature Tcat* in the cycle of the routine illustrated in FIG. 4. (4) A filter corresponds to the GPF 34. A determination process corresponds to the process of S18. A predetermined condition corresponds to the condition indicating that the logical product of Condition (A) and Condition (B) is true in the process of S20. (5) A setting process corresponds to continuously setting the target temperature Tcat* to a smaller value when the prescribed temperature THW0 in the process of S54. (6) A feedback process corresponds to the process which is restarted in the process of S26, and a prohibition process corresponds to the process of S22.

Other Embodiments

The aforementioned embodiment can be modified as follows. The aforementioned embodiment and the following modified examples can be combined unless technical conflictions arise.

"Acquisition Process"

In the aforementioned embodiment, the coolant temperature THW has been exemplified as the temperature of the internal combustion engine 10, but an applicable embodiment of the present disclosure is not limited thereto. For example, a detected value of a lubricant temperature of the internal combustion engine 10 may be employed. For example, when the internal combustion engine 10 includes only the port injection valve 16, fuel attached to the intake system when the temperature of the intake system such as the intake port 12*a* or the intake valve 18 is low remarkably causes an error of the estimated value Tcate and thus the detected value of the temperature of the intake system may be employed.

"Setting Process"

In the aforementioned embodiment, when none of a plurality of values of the input variable of the map data corresponds to the coolant temperature THW as the input variable, the target temperature Tcat* is set by interpolation of a pair of values with the coolant temperature THW interposed therebetween out of the plurality of values, but an applicable embodiment of the present disclosure is not limited thereto. For example, the value of the output variable corresponding to a value closest to the coolant temperature THW may be set as the target temperature Tcat*.

In the aforementioned embodiment, the target temperature Tcat* is set to one of three or more different values according to the coolant temperature THW, but an applicable embodiment of the present disclosure is not limited thereto. For example, the target temperature Tcat* may be set to one of two different values according to the coolant temperature THW.

It is not essential to set the maximum value of the target temperature Tcat* to the upper-limit temperature Tcat0. As described in the "rich combustion process" described below, the target temperature Tcat* may be set to a temperature which is lower by a prescribed value than the upper-limit temperature Tcat0 according to a control technique.

"Temperature Estimating Process"

The rich combustion variable is not limited to the increase coefficient K and, for example, the rich combustion variable may be constituted by a group of variables including the charging efficiency η and the required injection amount Qd.

The estimated value Tcate may not be set to the temperature of the three-way catalyst 32 when the operation state of the internal combustion engine 10 is normal, but the method of calculating the estimated value Tcate based on a physical model based on a sequential thermal energy balance is not limited to the example described in the embodiment. For example, an amount of thermal energy may be calculated based on an amount of fuel injected every time. In this case, when fuel is attached to the intake system or the cylinder block, an amount of injected fuel corresponding thereto may be considered to be converted to thermal energy, the estimated value Tcate may be calculated based on an amount of thermal energy which is greater than an actual value, and the estimated value Tcate may be temporarily higher than the actual temperature of the three-way catalyst 32. However, in this case, when the physical model uses the coolant temperature THW which is a variable indicating the temperature of a member exchanging heat with an exhaust system as an input as described above in the embodiment, the estimated value Tcate converges on the actual temperature of the three-way catalyst 32. Accordingly, when the attached fuel is vaporized after the estimated value Tcate has converged on the actual temperature of the three-way catalyst 32, it is effective to set the target temperature Tcat* to a low value.

In the aforementioned embodiment, the temperature of the cylinder block which is expressed by the coolant temperature THW has been exemplified as the variable indicating the temperature of the member exchanging heat with the exhaust system out of the input variables for calculating the estimated value Tcate, but an applicable embodiment of the present disclosure is not limited thereto and, for example, the temperature of outside air exchanging heat with the exhaust passage 30 may be used.

In the aforementioned embodiment, the temperature of the three-way catalyst 32 is a single temperature and the single temperature is estimated, but an applicable embodiment of the present disclosure is not limited thereto. For example, a section from upstream to downstream of the three-way catalyst 32 in the flowing direction of exhaust gas may be divided into a plurality of areas and temperatures of the areas may be estimated.

The process of calculating the estimated value of the temperature of the three-way catalyst 32 is not limited to a process using a physical model in consideration of heat exchange. For example, a physical model such as a linear regression expression or a neural network with the parameters described in the aforementioned embodiment or the modified examples thereof as inputs may be used. In this case, an output variable of a trained model may be used as an update amount of the temperature of the three-way catalyst 32 and the temperature may be updated by calculating the value of the output variable at predetermined intervals and adding the calculated value to the temperature of the three-way catalyst 32. Above all, it is not essential to use the output variable as the update amount and, for example, the trained model may be a regressively coupled neural network and the output variable may be a temperature.

The temperature estimating process is not limited to the physical model in consideration of heat exchange or the physical model using a trained model including the rich combustion variable as an input variable. For example, the temperature estimating process may be a process of estimating a normal temperature on which the temperature of the three-way catalyst 32 is considered to converge when the operation state of the internal combustion engine 10 is maintained. In this case, since estimation accuracy of the temperature of the three-way catalyst 32 decreases due to vaporization of fuel attached to the intake system or a cylinder bore and flowing thereof to the exhaust passage 30, it is effective to set the target temperature Tcat* in the same way as described above in the embodiment.

"Rich Combustion Process"

When the temperatures of a plurality of areas of the three-way catalyst 32 are estimated as described above in the "temperature estimating process," for example, a maximum value of the estimated values of the areas can be controlled such that it is equal to or less than the target temperature Tcat*. Above all, it is not essential to control the maximum value such that it is equal to or less than the target temperature Tcat*. For example, when the target temperature Tcat* is set according to an upper limit value of average values of the temperatures of the areas of the three-way catalyst 32 instead of setting the target temperature Tcat* according to the upper limit of the temperature of the three-way catalyst 32, the average value of the estimated value may be controlled such that it is equal to or less than the target temperature Tcat*.

For example, a process of setting the target temperature Tcat* to a temperature which is lower by a prescribed value than the value set in the aforementioned embodiment and sequentially updating the increase coefficient K based on the sum of an output of a proportional element and an output of an integral element with a difference between the target temperature Tcat* and the estimated value Tcate as an input may be employed. Here, the prescribed value can be set according to a maximum value of a degree of overshooting due to the output of the integral element.

The rich combustion process is not limited to the process including feedback control to the target temperature Tcat*. For example, when a process of setting the increase coefficient K to a larger value when the target temperature Tcat* is high than when the target temperature Tcat* is low is employed, it is effective to set the target temperature Tcat* to a lower value when the coolant temperature THW is low than when the coolant temperature THW is high.

"Temperature Increasing Process"

In the process of S22, the number of cylinders in which combustion control is stopped in one combustion cycle is set to one, but an applicable embodiment of the present disclosure is not limited thereto. For example, the number of cylinders may be set to two.

In the aforementioned embodiment, the cylinder in which combustion control is stopped is fixed to a predetermined cylinder in each combustion cycle, but an applicable embodiment of the present disclosure is not limited thereto. For example, the cylinder in which combustion control is stopped may be changed at predetermined intervals.

The temperature increasing process is not limited to the process with one combustion cycle as a period. For example, when four cylinders are provided as in the aforementioned embodiment, the cylinder in which combustion control is stopped may be provided by one in the same period with a period which is five times an appearance interval of a compression top dead center as a period. According to this configuration, the cylinder in which combustion control is stopped can be changed to a period which is five times the appearance interval of the compression top dead center.

"Execution Conditions of Temperature Increasing Process"

In the aforementioned embodiment, Condition (A) and Condition (B) are exemplified above as the predetermined condition in which the temperature increasing process is performed when there is a request for performing the temperature increasing process, but the predetermined condition is not limited thereto. For example, only one of the two conditions including Condition (A) and Condition (B) may be included.

"Estimation of Deposition Amount"

The process of estimating the deposition amount DPM is not limited to the process illustrated in FIG. 2. For example, the deposition amount DPM may be estimated based on a difference in pressure between upstream and downstream of the GPF 34 and the amount of intake air Ga. Specifically, the deposition amount DPM can be estimated as a larger value when the different in pressure is great than when the difference in pressure is small, and the deposition amount DPM can be estimated as a larger value when the amount of intake air Ga is small than when the amount of intake air Ga is large even if the difference in pressure is the same. Here, when the pressure downstream from the GPF 34 is considered as a fixed value, a detected value of the pressure upstream from the GPF 34 can be used instead of the difference in pressure.

"Post-Processing Device"

The post-processing device is not limited to a device including the GPF 34 downstream from the three-way catalyst 32 and may employ, for example, a configuration in which the three-way catalyst 32 is provided downstream from the GPF 34. The post-processing device is not limited to the configuration including the three-way catalyst 32 and the GPF 34. For example, only the GPF 34 may be provided. For example, when the post-processing device includes only the three-way catalyst 32, it is effective to perform the processes described in the aforementioned embodiment or the modified examples thereof when it is necessary to increase the temperature of the post-processing device at the time of performing of the regeneration process. When the post-processing device includes the three-way catalyst 32 and the GPF, the GPF is not limited to a filter in which a three-way catalyst is carried and may include only the filter.

"Control Device"

The control device is not limited to a control device including a CPU 72 and a ROM 74 and performing software processes. For example, a dedicated hardware circuit such as an ASIC that performs at least some of the software processes which have been performed in the aforementioned embodiment in hardware may be provided. That is, the control device may have at least one of the following configurations (a) to (c): (a) A configuration in which a processor that performs all the processes in accordance with a program and a program storage device such as a ROM that stores the program are provided; (b) A configuration in which a processor that performs some of the processes in accordance with a program, a program storage device, and a dedicated hardware circuit that performs the other processes are provided; and (c) A configuration in which a dedicated hardware circuit that performs all the processes is provided. Here, the number of software executing devices including a processor and a program storage device or the number of dedicated hardware circuits may be two or more.

"Vehicle"

The vehicle is not limited to a series/parallel hybrid vehicle and, for example, a parallel hybrid vehicle or a series hybrid vehicle may be employed. Above all, the vehicle is not limited to a hybrid vehicle but may be, for example, a vehicle including only an internal combustion engine 10 as a power generator for the vehicle.

What is claimed is:

1. A control device for an internal combustion engine that is applied to a multi-cylinder internal combustion engine including a post-processing device for exhaust gas in an exhaust passage, the control device including a central processing unit (CPU) and a non-transitory computer readable medium having instructions which, when executed by the CPU, cause the CPU to perform:

an acquisition process of acquiring a temperature of the multi-cylinder internal combustion engine;

a setting process of setting a target temperature of the post-processing device; and a temperature increasing process of increasing a temperature of the post-processing device to the target temperature, wherein the temperature increasing process includes a stopping process and a rich combustion process, wherein the stopping process is a process of stopping combustion control in at least one cylinder of a plurality of cylinders, wherein the rich combustion process is a process of setting an air-fuel ratio of an air-fuel mixture in the other cylinders other than the at least one cylinder out of the plurality of cylinders to be less than a stoichiometric air-fuel ratio, and wherein the setting process is a process of setting the target temperature to a lower temperature when the temperature acquired in the acquisition process is below an engine temperature threshold than when the temperature is above the engine temperature threshold.

2. The control device for the internal combustion engine according to claim 1, wherein the control device is configured to further perform a temperature estimating process of calculating an estimated value of the temperature of the post-processing device based on a value of a rich combustion variable, wherein the rich combustion variable is a variable indicating the air-fuel ratio of an air-fuel mixture in the other cylinders in the rich combustion process, and wherein the rich combustion process includes a process of decreasing a degree of enrichment when an amount by which the estimated value is lower than the target temperature is equal to or below a threshold compared with when the amount is above a threshold.

3. The control device for the internal combustion engine according to claim 1, wherein the setting process includes a process of updating the target temperature based on the temperature acquired in the acquisition process at predetermined intervals.

4. The control device for the internal combustion engine according to claim 3, wherein the post-processing device includes a filter that collects particulate matter in exhaust gas, wherein the control device is configured to perform a determination process of determining that there is a request for performing the temperature increasing process when an amount of particulate matter collected by the filter is equal to or greater than a threshold value, and wherein the temperature increasing process is a process which is performed when it is determined in the determination process that there is a request for performing the temperature increasing process and an operation state of the internal combustion engine satisfies a predetermined condition and which is completed when the amount of particulate matter is equal to or less than a predetermined amount, and is stopped when the predetermined condition is not satisfied while the temperature increasing process is being performed, and is then restarted when the predetermined condition is satisfied again.

5. The control device for the internal combustion engine according to claim 1, wherein the setting process is a process of setting the target temperature to three or more different values for each temperature acquired in the acquisition process.

6. The control device for the internal combustion engine according to claim 1, wherein the control device is configured to further perform:

a feedback process of performing feedback control such that the air-fuel ratio of the air-fuel mixture reaches a target air-fuel ratio; and a prohibition process of prohibiting the feedback process when the temperature increasing process is being performed.

* * * * *